US006761357B2

(12) United States Patent
Witt et al.

(10) Patent No.: US 6,761,357 B2
(45) Date of Patent: Jul. 13, 2004

(54) ADJUSTABLE AND COLLAPSIBLE TARGET HOLDER

(76) Inventors: Billy Ray Witt, R.R.1, Box 258B, Bluefield, WV (US) 24701; Dennis Carl Meadows, 898 Old Lashmeet Rd., Rock, WV (US) 24747

( * ) Notice: Subject to any disclaimer, the term of this patent is extended or adjusted under 35 U.S.C. 154(b) by 0 days.

(21) Appl. No.: 10/145,675

(22) Filed: May 14, 2002

(65) Prior Publication Data

US 2003/0213880 A1 Nov. 20, 2003

(51) Int. Cl.[7] ..... F41J 1/00
(52) U.S. Cl. ..... 273/407
(58) Field of Search ..... 273/403, 404, 273/406, 407, 408

(56) References Cited

U.S. PATENT DOCUMENTS

| | | | | | |
|---|---|---|---|---|---|
| 2,048,155 | A | * | 7/1936 | Armantrout | 273/407 |
| 2,372,111 | A | | 3/1945 | Norberg | |
| 2,538,118 | A | | 1/1951 | Miller | |
| 2,722,420 | A | | 1/1955 | Adamson | |
| 3,080,166 | A | | 3/1963 | Clark | |
| 3,355,174 | A | | 11/1967 | Hutson | |
| 3,540,729 | A | | 11/1970 | Rahberger | |
| 3,601,353 | A | | 8/1971 | Dale | |
| 4,029,318 | A | * | 6/1977 | Boss | 273/390 |
| 4,054,288 | A | * | 10/1977 | Perrine, Sr. | 273/407 |
| 4,913,389 | A | | 4/1990 | McCracken | |
| 5,067,683 | A | | 11/1991 | Wager | |
| 5,145,133 | A | * | 9/1992 | France | 248/168 |
| 5,507,111 | A | * | 4/1996 | Stinson et al. | 42/94 |
| 5,634,640 | A | * | 6/1997 | McCarrel | 473/446 |
| 5,671,924 | A | * | 9/1997 | Scott | 273/407 |
| 5,678,824 | A | * | 10/1997 | Fortier et al. | 273/407 |
| 5,860,654 | A | | 1/1999 | Jacobs | |
| 6,257,584 | B1 | * | 7/2001 | Nasuti | 273/407 |
| 6,484,990 | B1 | * | 11/2002 | Marshall | 248/316.1 |

* cited by examiner

*Primary Examiner*—Mark S. Graham
(74) *Attorney, Agent, or Firm*—Jackson Kelly PLLC; Monika J. Hussell

(57) ABSTRACT

A durable, adjustable, and collapsible target holder comprised generally of a pair of vertical poles vertically secured end to end, a pair of horizontal poles removable secured at adjustable heights to the vertical poles, and target restraint means secured to the ends of, and running the length of, the said horizontal poles. The target restraint means of the present invention comprise a flexible material capable of withstanding the direct hit of ammunition. Preferably, the target restraint means are a rubber strap with nubbings on the interior thereof to hold the target in place.

15 Claims, 3 Drawing Sheets

ADJUSTABLE AND COLLAPSIBLE TARGET HOLDER

BACKGROUND OF INVENTION

The present invention relates to a durable, adjustable and collapsible target holder, and more particularly pertains to a target holder capable of holding different sized targets at a variety of heights and widths. The present invention also relates to target holder restraint means capable of withstanding the direct strike of ammunition or arrowheads.

The art of target holders prior to this invention included collapsible target holders and adjustable target holders to accommodate varying target sizes. Furthermore, the art of target holders includes means to removably secure a target to the target holder, e.g., U.S. Pat. Nos. 2,538,118, 2,722,420, and 3,540,729) that are subject to immediate destruction upon the direct strike of ammunition or arrowheads.

Therefore, there is a need in the art for a collapsible target holder which is easy to assemble and disassemble; a need for a target holder that adjusts to accommodate varying widths and heights of targets; and a need for a target holder with target restraint means capable of withstanding the direct strike of ammunition or arrowheads.

SUMMARY OF INVENTION

The objects of this invention include developing a target holder which is easy to assemble and disassemble; designing a target holder which can accommodate and adjust to varying widths and heights of targets; and developing a target holder with target restraint means which are capable of withstanding the direct strike of ammunition or arrowheads. Other and further objects of this invention will be apparent to those skilled in the art to which it relates from the following specification, claims and drawings.

The invention meets all of these objects. Generally, the invention is for a new and improved target holder comprising a pair of vertical poles, removably secured to one another at the ends thereof, and a pair of horizontal poles removably secured to said vertical poles. The horizontal poles are removably secured to the vertical poles such that they can be positioned anywhere along the vertical poles to accommodate targets of varying heights.

The device of the present invention further comprises target restraint means capable of withstanding the direct strike of ammunition or arrowheads, such restraint means being secured to each of said horizontal poles and running the length of the horizontal poles. The target restraint means are secured to said horizontal poles only at the relative ends thereof, with the remainder of such restraint means taut against but free from the horizontal poles, such that a target may be held in place thereby.

The simple assembly of the device of the present invention requires the user only to connect the two vertical poles and secure thereto the horizontal poles, positioning the same at a height desirable in accordance with the height of the target. The lower vertical pole may be positioned in the ground either before or after assembly.

The simple disassembly the device of the present invention requires the user only to disconnect the horizontal poles from the vertical poles, release the second vertical pole from the first, and remove the first vertical pole from the ground.

A more detailed description of the preferred embodiment of the device of the present invention follows.

DETAILED DESCRIPTION

With reference now to the drawings, the following is a description of the preferred embodiment of the new and improved durable, adjustable and collapsible target holder of the present invention. Specifically, it will be noted in the various Figures that the device relates to a new and improved target holder with restraint means capable of holding different sized targets at a variety of heights, the device being collapsible and the target restraint means being capable of withstanding the direct strike of ammunition or arrow heads. In its broadest context, the device comprises a pair of vertical poles (1) and (2), two horizontal poles (3) removably secured to said vertical poles, and target restraint means (3C) secured to each of said horizontal poles (3).

Figure 1:
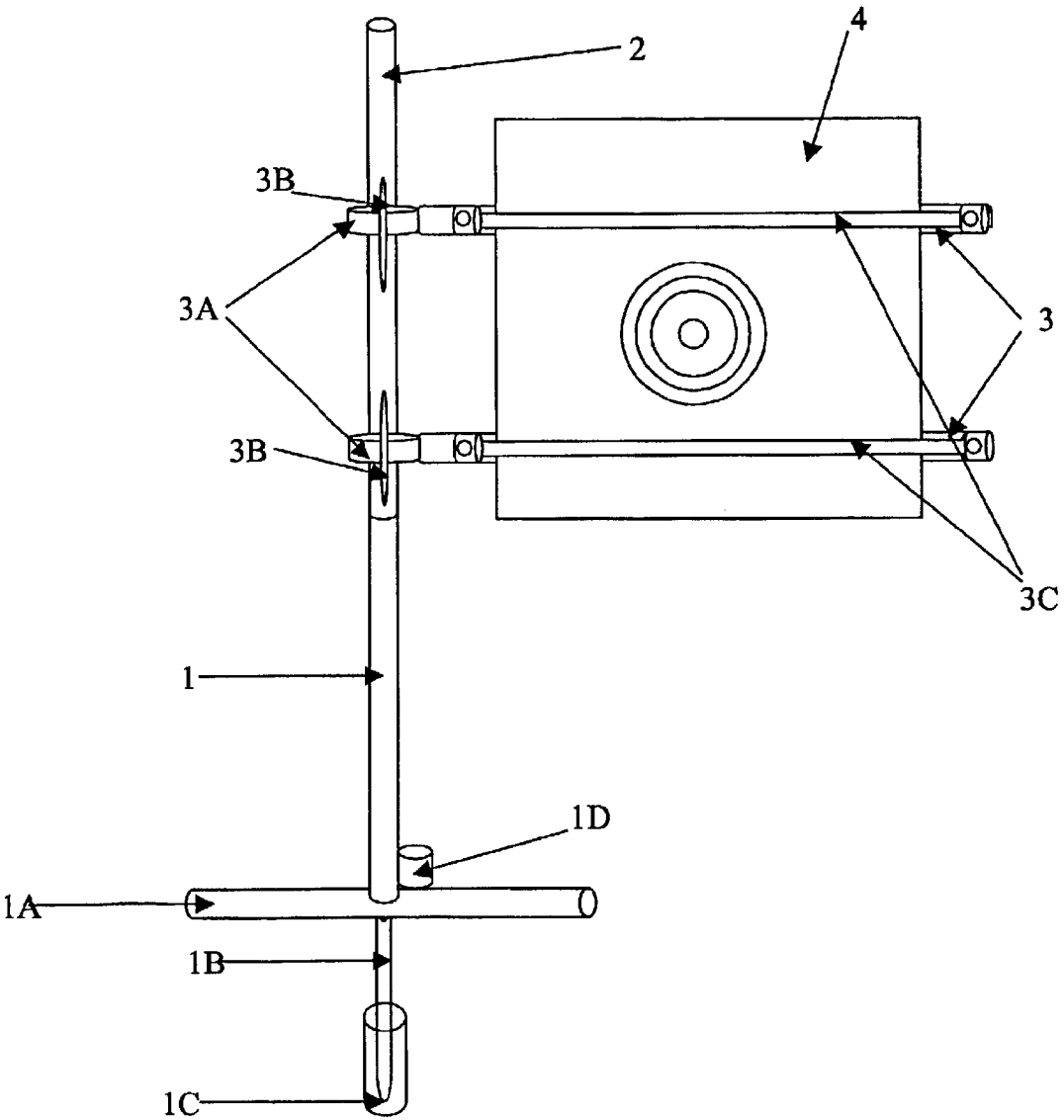
FIG. 1 is a front view of a fully assembled, preferred embodiment of the device of the present invention.

The vertical poles (1) and (2) of the present invention preferably comprise hollow, metal poles, with the upper end of the first pole (1) removably secured to the lower end of the second pole (2), as generally depicted in FIG. 1. Your inventors prefer to thread the interior of the upper end of the first vertical pole (1) and correspondingly thread the exterior of the lower end of the second vertical pole (2) (or vice versa), so that the poles may be removably secured in accordance with the present invention; however, it would be understood by one skilled in the art that any means to removably secure the vertical poles (1) and (2) would satisfy the objects of the invention.

In order to stabilize the device of the present invention when in use, and for ease of positioning the device in the ground, your inventors prefer to attach, removably or fixedly, to the lower end of the first vertical pole (1), a t-bar (1A) and a stake (1B), as depicted in FIG. 1. Alternatively, the lower end of the first vertical pole (1) may have a pointed end or stake integral therewith and a t-bar secured at and perpendicular to the lower portion of the vertical pole (1), or other means to stabilize the device of the present invention and position the same in the ground.

Figure 2:
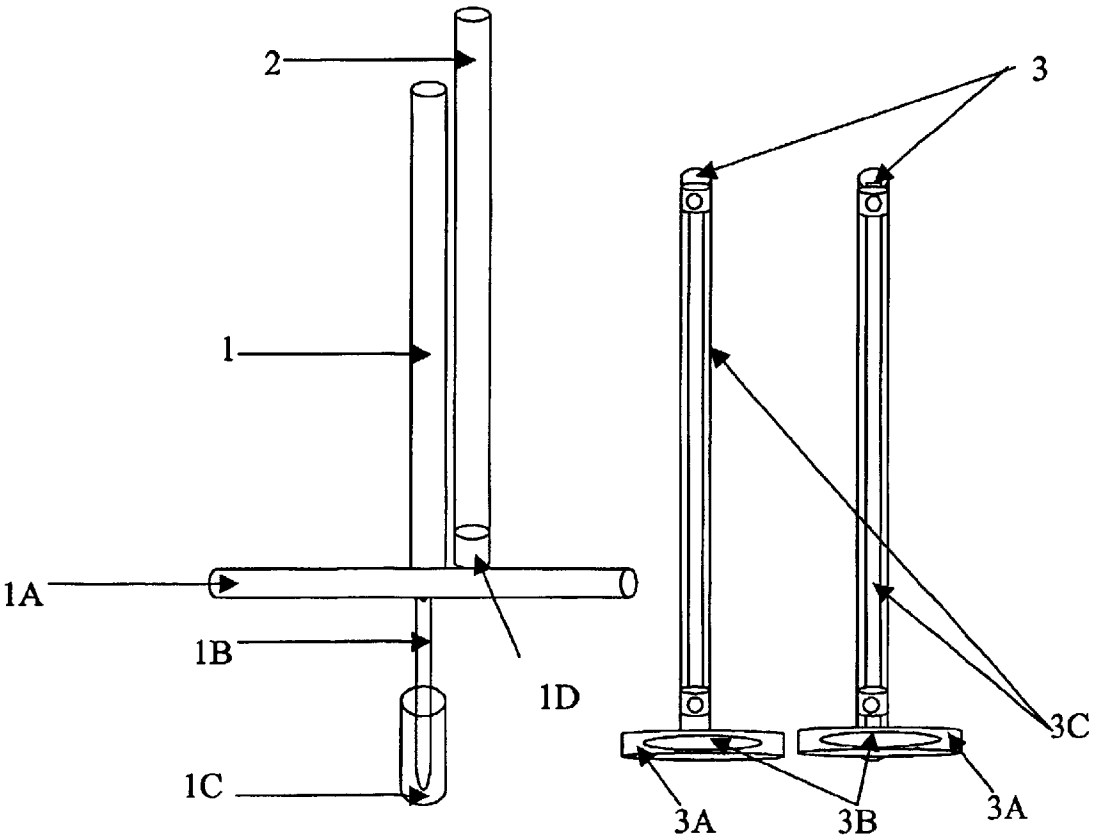
FIG. 2 is a front view of a preferred embodiment of the device of the present invention, assembled for transport and storage.

For controlled storage, your inventors prefer to weld or otherwise secure a nut (1D) to the lower end of the first pole (1) or to the t-bar (1A), whereby the interior of the nut (1D) is threaded to receive the threaded lower end of the second vertical pole (2). When not in use, the various components of the invention can be disassembled, and the second pole (2) can be secured to the first pole (1) by screwing the lower end thereof into the nut (1D), as depicted in FIG. 2.

Figure 3:
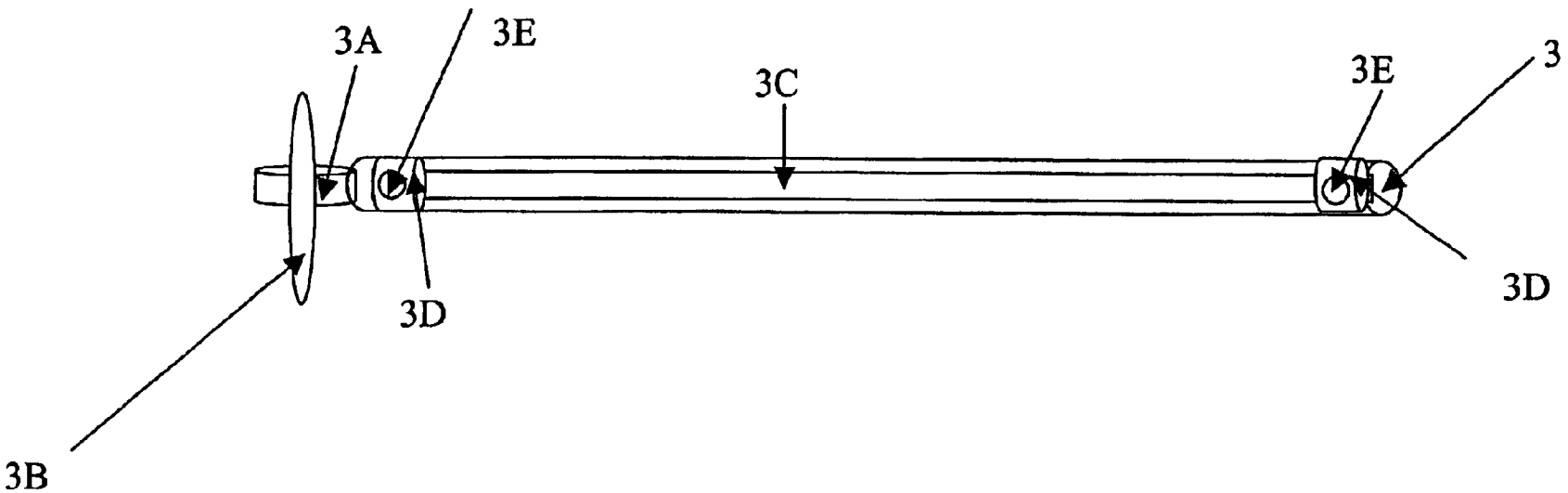
FIG. 3 is a front view of a preferred embodiment of the horizontal poles and target restraint means of the device of the present invention.

The horizontal poles (3) each preferably comprises a hollow, metal pole, having secured at the first end thereof a circular ring (3A) as depicted in FIGS. 1 and 3, said circular ring having a slightly larger dimension than the vertical poles (1) and (2), permitting the ring (3A) to slide freely along said poles to accommodate different target heights. In order to removably secure the horizontal poles (3) in place on the vertical poles (1) and/or (2), your inventors prefer to use a T-handle locking bolt (3B), cooperating with a threaded hole incorporated in the circular ring (3A), so that when a horizontal pole (3) is at the desired vertical position on the vertical pole (1) or (2), the T-handle locking bolt (3B) is screwed entirely through the threaded hole in the circular ring (3A) until it is in contact with the vertical pole (1) or (2), thereby securing the horizontal pole (3) to the vertical pole (1) or (2). While this is the preferred method of removably securing the horizontal poles (3) to the vertical poles (1) and (2), it would be understood by one skilled in the art that other methods of removably securing the said horizontal pole (3) to the vertical pole (1) or (2) would satisfy the objects of the invention.

To hold targets of varying widths, attached to each of the horizontal poles (3) are target restraint means (3C), running substantially the length of the pole. Said target restraint means, when secured to the horizontal pole (3) at or near the ends thereof, should be sufficiently taut against the pole to hold the target (4) in place. It is important to note that, except at the relative ends of the horizontal poles (3), the target restraint means (3C) are taut against the horizontal poles (3) but not secured. Your inventors prefer to use a rubber strap with nubbings on the interior side thereof, or bungee cord with ends removed, as target restraint means; however, any stretchable material capable of being taut against the horizontal pole (3) to hold the target (4) in place would be suitable. When using the preferred rubber strap or bungee cord, your inventors prefer to removably secure the same to the horizontal poles (3) at the ends only by means of a retaining clip, cut in half (3D), secured on top of and near the ends of the rubber strap/bungee cord by a screw (3E) traveling through such retaining clip (3D), the rubber strap/bungee cord, and a threaded hole in the horizontal pole (3).

In transport, a protector cap (1C) may be removably placed on the stake (1B) to protect persons handling it from injury.

In practice, after removing the protector cap (1C), if any, from the stake (1B), the lower support pole (1) is pushed into the ground with foot pressure applied to the t-bar (1A). It then becomes a rigid support for the upper support pole (2) and the lower end of the upper support pole (2) is removably secured to the upper end of the lower support pole (1), making the complete vertical support pole for the horizontal poles (3). The circular rings (3A) of the horizontal poles (3) are then engaged with the-vertical support poles (1) and (2) and secured in place by means of the T-handle locking bolts (3B).

To disassemble the device of the present invention, the target (4) is removed from the horizontal poles, the horizontal poles (3) are removed from the support poles (1) and (2) by loosening the T-handle locking bolts (3B), the support poles (1) and (2) are separated, the lower support pole (1) is removed from the ground, and preferably the upper support pole (2) is screwed into the nut (1D) for storage.

As to the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modification and changes will readily occur to those skill in the art, it is not desired to limit the invention to the exact construction and operation shown and described, and accordingly, all suitable modification and equivalents may be resorted to, falling within the scope of the invention.

We claim:

1. An adjustable target holder for holding different sized targets at a variety of heights comprising, in combination, a first vertical pole;

a second vertical pole removably secured to the first vertical pole;

two horizontal poles, each removably secured to either the first or the second vertical pole; and target restraint means removably secured to, running substantially the length of, and taut against each horizontal pole.

2. The adjustable target holder of claim 1, wherein the vertical and horizontal poles each comprise a hollow, metal pole.

3. The adjustable target holder of claim 1, wherein the second vertical pole is removably secured to the first vertical pole by means of corresponding threading, incorporated into the interior of the upper end of the said first vertical pole and the exterior of the lower end of: the said second vertical pole.

4. The adjustable target holder of claim 1, wherein the second vertical pole is removably secured to the first vertical pole by means of corresponding threading, incorporated into the exterior of the upper end of the said first vertical pole and the interior of the lower end of the said second vertical pole.

5. The adjustable target holder of claims 3 or 4, further comprising a nut secured to the first vertical pole, said nut being threaded to be capable of receiving the lower end of the second vertical pole such that the poles will be parallel when prepared for storage.

6. The adjustable target holder of claim 1, wherein said horizontal poles each have secured at an end thereof a circular ring, said circular ring having a slightly larger dimension than the vertical poles.

7. The adjustable target holder of claim 6, further comprising a T-handle locking bolt with a threaded shaft; and wherein said circular ring contains a threaded hole for receiving the T-handle locking bolt.

8. The adjustable target holder of claim 1, whereby the target restraint means are manufactured from a stretchable material.

9. The adjustable target holder of claim 8, whereby the stretchable material is a rubber strap.

10. The adjustable target holder of claims 8, or 9, whereby each of the said horizontal poles contain at least two threaded holes and whereby the target restraint means further comprise at least one retaining clip, cut in half, and at least two screws, whereby said target restraint means are secured to the horizontal pole by inserting the screw through one half of the retaining clip, the stretchable material and into the said threaded hole of the horizontal poles.

11. The adjustable target holder of claim 1, further comprising means to stabilize the device of the present invention and position the same in the ground.

12. The adjustable target holder of claim 11, wherein the means to stabilize and position the device comprise a stake integral with the lower end of the first vertical pole, and further comprise a t-bar secured at and perpendicular to the lower portion of the lower end of the said first vertical pole.

13. The adjustable target holder of claim 11, wherein the means to stabilize and position the device comprise a t-bar perpendicularly attached to the lower end of the first vertical pole and a stake attached to the lower end of the first vertical pole and extending therefrom.

14. The adjustable target holder of claim 12 or 13, further comprising a protector cap removably placed on the stake.

15. The adjustable target holder of claim 1, further comprising a target, positioned and held in place between the target restraint means and the horizontal poles.

* * * * *